US011273535B2

(12) United States Patent
Stuckenholz et al.

(10) Patent No.: US 11,273,535 B2
(45) Date of Patent: Mar. 15, 2022

(54) ABRASIVE TOOL AND METHOD FOR PRODUCING AN ABRASIVE TOOL OF THIS KIND

(71) Applicant: PFERD MILWAUKEE BRUSH COMPANY, INC., Milwaukee, WI (US)

(72) Inventors: Bernd Stuckenholz, Bergisch Gladbach (DE); Peter Walder, Wipperführt (DE)

(73) Assignee: PFERD MILWAUKEE BRUSH COMPANY, INC., Milwaukee, WI (US)

( * ) Notice: Subject to any disclaimer, the term of this patent is extended or adjusted under 35 U.S.C. 154(b) by 939 days.

(21) Appl. No.: 15/754,071

(22) PCT Filed: Aug. 21, 2015

(86) PCT No.: PCT/EP2015/069267
§ 371 (c)(1),
(2) Date: Feb. 21, 2018

(87) PCT Pub. No.: WO2017/032396
PCT Pub. Date: Mar. 2, 2017

(65) Prior Publication Data

US 2018/0243885 A1 Aug. 30, 2018
US 2020/0047315 A2 Feb. 13, 2020

(51) Int. Cl.
*B24D 13/04* (2006.01)
*B24D 3/34* (2006.01)
(Continued)

(52) U.S. Cl.
CPC ..... *B24D 13/04* (2013.01); *B24D 3/348* (2013.01); *B24D 13/06* (2013.01); *B24D 13/16* (2013.01)

(58) Field of Classification Search
CPC ..... B24D 13/04; B24D 13/06; B24D 3/348; B24D 13/16
See application file for complete search history.

(56) References Cited

U.S. PATENT DOCUMENTS

2003/0134584 A1 7/2003 Eisenblaetter
2012/0000135 A1* 1/2012 Eilers ..... B24D 18/00 51/295

(Continued)

FOREIGN PATENT DOCUMENTS

CN 1438930 A 8/2003
DE 9002385.4 U1 5/1990

(Continued)

OTHER PUBLICATIONS

Office Action for corresponding Chinese Application No. 201580082378.3, dated Feb. 2, 2019, with English translation.

(Continued)

*Primary Examiner* — Pegah Parvini
(74) *Attorney, Agent, or Firm* — Bowdy and Neimark, PLLC

(57) ABSTRACT

An abrasive tool includes a support, on which a plurality of abrasive flaps is arranged. The abrasive flaps each have a base and abrasive material, which is attached to the base by means of a binder. To increase the useful life and total material abrasion, the abrasive flaps are reinforced by a cured filling resin. The reinforcement of the abrasive flaps reduces the cyclical deflection thereof around a zero position due to workpiece machining, thereby avoiding increased wear on the abrasive flaps.

10 Claims, 6 Drawing Sheets

(51) Int. Cl.

| | |
|---|---|
| ***B24D 13/06*** | (2006.01) |
| ***B24D 13/16*** | (2006.01) |

(56) References Cited

U.S. PATENT DOCUMENTS

| | | | | |
|---|---|---|---|---|
| 2012/0071073 | A1* | 3/2012 | Farber | B24D 13/16 451/490 |
| 2012/0167478 | A1 | 7/2012 | Herbert | |
| 2014/0080392 | A1* | 3/2014 | Eisenblaetter | B24D 11/00 451/490 |

FOREIGN PATENT DOCUMENTS

| | | | |
|---|---|---|---|
| EP | 1306162 | A1 | 5/2003 |
| EP | 2153939 | A1 | 2/2010 |
| EP | 2708326 | A2 | 3/2014 |
| JP | S62188675 | A | 8/1987 |
| JP | S6416376 | A | 1/1989 |
| JP | H10180637 | A | 7/1998 |
| JP | H10217130 | A | 8/1998 |
| JP | 2001287167 | A | 1/2001 |
| JP | 2014508046 | A | 4/2014 |

OTHER PUBLICATIONS

Office Action for corresponding Russian Application No. 2018104543/02, dated Feb. 1, 2019, with English translation.
Brazilian office action dated Dec. 30, 2020, from corresponding Brazilian patent application No. BR 11 2018 003 397.9.
Canadian office action dated Jan. 18, 2021, from corresponding Canadian patent application No. 2,995,886.
Office Action for corresponding Chinese Application No. 201580082378.3, dated Feb. 3, 2019, with English translation.
Office Action for corresponding Chinese Application No. 201580082378.3, dated Mar. 2, 2020.
Brazilian Office Action for corresponding Brazilian application No. BR112018003397-9, dated Jan. 22, 2020.
Indian Office Action including English translation for corresponding Indian application No. 201847009644, dated Feb. 21, 2020.
Japanese Office Action for corresponding Japanese Application No. 2018-508653 dated Jun. 1, 2018, with partial English translation.

* cited by examiner

ABRASIVE TOOL AND METHOD FOR PRODUCING AN ABRASIVE TOOL OF THIS KIND

FIELD

The invention relates to an abrasive tool having
- a support,
- a plurality of abrasive flaps,
  - which are arranged on the support and
  - which each have a base and abrasive material, wherein the abrasive material is attached to the base by means of a binder.

The invention furthermore relates to a method for producing an abrasive tool.

BACKGROUND

EP 2 153 939 A1 discloses an abrasive tool in the form of an abrasive flap disk. The abrasive flaps used are produced from abrasive material on a base. The base wears during the abrasion process, and therefore used abrasive material adhering to the base is removed and new abrasive material is repeatedly brought into abrasive engagement. The use of the abrasive tool is all the more economical, the longer the useful life and the greater the total material removal during the machining of a workpiece up to the point of complete wearing of the abrasive tool.

SUMMARY

It is the underlying object of the invention to provide an abrasive tool that has a longer useful life and a greater total material removal.

This object is achieved by an abrasive tool, in which at least one of the abrasive flaps has a cured filling resin for reinforcement. It has been recognized that the abrasive flaps on prior-art abrasive tools are subject to pronounced cyclical deflection. The cyclical deflection of the abrasive flaps results from the rotation of the abrasive tool and the abrasive engagement of a certain number of adjacent abrasive flaps during the machining of a workpiece. The extent of the cyclical deflection and hence the loading of the abrasive flaps is dependent on the oblique positioning of the abrasive tool relative to the workpiece surface to be machined, the width of the workpiece to be machined, the speed and outside diameter of the abrasive tool and the contact force with which the abrasive flaps are pressed perpendicularly against the workpiece surface in the abrasion process. Owing to the pronounced cyclical deflection of the abrasive flaps, the abrasive material, which is in the form of abrasive particles or abrasive grains, is torn out of the base before the abrasive material has worn out and achieved its material removal potential. Moreover, the abrasive material layer is weakened by the torn-out abrasive material, i.e. the torn-out abrasive particles or abrasive grains, since adjacent abrasive particles can no longer support each other. This leads to premature breakout, especially in the case of the last abrasive particles arranged at the ends of the abrasive flaps, these particles being supported on only one side. Overall, therefore, the pronounced cyclical deflection of the abrasive flaps severely impairs the useful life and total material removal of the abrasive tool.

Reinforcing the abrasive flaps greatly reduces the cyclical deflection thereof in comparison with the prior art. Thus, a longer useful life and greater overall material removal of the respective abrasive tool are achieved. The longer useful life and greater overall material removal are achieved without increasing the amount of wear on the base. In the case of abrasive material on a base, removal of the base with used abrasive material during the abrasion process takes place by fluffing. Fluffing means disintegration of the base into dust particles or small fibers or fiber bundles. The mass of disintegrated base relative to the mass of the abrasive tool overall is defined as the amount of wear on the base. A large amount of wear on the base is disadvantageous since respirable dust particles are thereby produced. An increased amount of wear is avoided in the case of the abrasive tool according to the invention. The amount of wear is at least constant relative to a prior-art abrasive tool of the same kind. Reinforcing the abrasive flaps reduces the ratio of the amount of wear on the base to the total material removal. The total material removal and the useful life of the abrasive tool are variably increased.

The abrasive flaps are reinforced by providing the abrasive flaps with a filling resin and then curing the filling resin. The filling resin is chosen from the group comprising thermosets, elastomers, synthetic resins and/or thermoplastics and combinations thereof, for example. The filling resin is preferably a thermoset, e.g. a phenolic resin. For example, the phenolic resin is a resol or a novolak. To ensure permanent reinforcement of the abrasive flaps, the filling resin should not exhibit any softening behavior below a limiting temperature. This means, for example, that, when it reaches the limiting temperature, the filling resin suffers a loss of strength relative to that at room temperature which does not exceed a maximum permissible loss of strength. The limiting temperature and the maximum permissible loss of strength are dependent on the desired degree of reinforcement of the abrasive flaps.

In the case of the abrasive tool according to the invention, at least one of the abrasive flaps has a cured filling resin. Preferably, a plurality of abrasive flaps has a cured filling resin, in particular at least 30%, in particular at least 50% and, in particular, at least 60% of the abrasive flaps secured on the support. For example, all the abrasive flaps arranged on the support have a cured filling resin.

The abrasive tool according to the invention is designed as an abrasive flap disk, abrasive flap wheel or abrasive flap wheel with shafts, for example. The abrasive tool has a central axis and is driven in rotation about the central axis by means of a tool drive in order to machine a workpiece. The reinforcement of the abrasive flaps reduces the cyclical deflection of the abrasive flaps, thereby increasing the useful life and total material removal.

An abrasive tool, in which the respective base is provided with the cured filling resin, ensures a longer useful life and greater total material removal in a simple manner. By virtue of the fact that the base of the respective abrasive flap is provided or soddened with filling resin, which then cures, the abrasive flaps can be reinforced in a simple and effective manner. Preferably, there is at least 70% by weight, in particular at least 80% by weight, in particular at least 90% by weight and, in particular, 100% by weight of the cured filling resin in the base.

An abrasive tool, in which the respective base comprises at least one thread, which is provided with the cured filling resin, ensures a longer useful life and greater total material removal in a simple manner. The respective base has a supporting textile comprising at least one thread. The supporting textile is designed as a woven supporting fabric, for example, which is formed by warp and weft threads. The supporting textile has at least one thread which is provided or soddened with the filling resin. After the curing of the filling resin, the at least one thread is reinforced. In the case of a woven textile fabric, for example, the warp threads and the weft threads are reinforced. The supporting textile thus has a high stiffness or bending stiffness, as a result of which the deflection of the respective abrasive flap is greatly reduced during the abrasion process.

An abrasive tool, in which the cured filling resin makes up 1% by weight to 30% by weight, in particular 5% by weight to 25% by weight and, in particular, 8% by weight to 20% by weight of the total weight of an abrasive flap, ensures effective reinforcement and thus a longer service life and greater total material removal.

An abrasive tool, in which at least one strength-enhancing filler is incorporated into the cured filling resin, ensures increased stiffness and thus a longer useful life as well as greater material removal. The at least one strength-enhancing filler is in the form of fibers, platelets and/or spheres, for example. Examples of fibrous fillers are glass fibers, carbon fibers, synthetic fibers, cellulose, wollastonite and whiskers. The term whiskers refers to acicular monocrystals. The materials antimony, cadmium, indium, zinc and tin tend to form whiskers, for example (cf. R. J. Klein Wassink: Weichlöten in der Elektronik [Soldering in Electronics], Eugen G. Leuze Verlag, 1991, pages 305 to 306).

Examples of fillers in the form of platelets are mica, talc and graphite. Examples of fillers in the form of spheres are quartz, silica, kaolin, glass balls, calcium carbonate, metal oxides and carbon black. Examples of suitable strength-enhancing fillers are chalks and alumina ($Al_2O_3$).

An abrasive tool, in which at least one filler with an abrasive action is incorporated into the cured filling resin, ensures a longer useful life and greater total material removal. By means of the at least one filler with an abrasive action, the abrasive properties of the abrasive flaps are improved and/or adjusted selectively for a particular application. Examples of fillers with an abrasive action are cryolite and potassium tetrafluoroborate ($KBF_4$). The at least one filler with an abrasive action has a particle size in the nanoscale range, for example.

By means of an abrasive tool, in which the support is of dish-shaped design, and in which the abrasive flaps are bonded laterally onto the support in such a way as to overlap one another, an abrasive flap disk with a longer useful life and greater total material removal is provided.

It is furthermore the underlying object of the invention to provide a method for producing an abrasive tool with a longer useful life and greater total material removal.

This object is achieved by a method, comprising the following steps:

- providing a plurality of abrasive flaps, which each have a base and abrasive material, wherein the abrasive material is attached to the base by means of a binder,
- arranging and securing the abrasive flaps on a support,
- providing at least one of the abrasive flaps, in particular of the respective base, with a filling resin,
- curing the filling resin to reinforce the at least one abrasive flap.

The advantages of the method according to the invention correspond to the already described advantages of the abrasive tool according to the invention. In particular, the method according to the invention can also be refined with the features of the abrasive tool according to the invention. By virtue of the fact that the abrasive flaps are provided with a filling resin which then cures, the abrasive flaps are reinforced in an effective manner. The reinforcement of the abrasive flaps significantly reduces the cyclical deflection thereof during the machining of a workpiece, thereby increasing the useful life and total material removal. The abrasive flaps are provided with the filling resin by adhesive bonding, lamination or dipping, for example. The abrasive flaps are provided with the filling resin before and/or during and/or after the arrangement or securing of the abrasive flaps on the support. In particular, the abrasive flaps are provided with the filling resin in such a way that it is primarily the respective base which absorbs the filling resin and/or the abrasive material and the abrasive material layer is normally not completely covered by the filling resin. The respective base preferably comprises a supporting textile, which is soddened with the filling resin and absorbs said resin. After the curing of the synthetic resin, the supporting textile is reinforced, i.e. has an increased bending stiffness. The filling resin is preferably cured by supplying heat, e.g. by means of a furnace.

A method, in which the at least one abrasive flap is dipped into a bath containing filling resin, is a simple means of ensuring the production of an abrasive tool with a longer useful life and greater total material removal. By dipping the abrasive flaps into a bath containing filling resin, the abrasive flaps, in particular the respective base, are soddened in a simple manner with the filling resin. The abrasive flaps are preferably dipped into the bath of filling resin in such a way that the filling resin drips more easily from the abrasive material than from the base owing to gravity. For example, the abrasive flaps are dipped into the bath of filling resin in such a way that the abrasive material is oriented in the direction of gravity and the base is oriented counter to gravity. This ensures that it is essentially the base which is soddened with the filling resin.

A method, in which the abrasive flaps are provided with the filling resin after the flaps have been arranged on the support, is a simple means of ensuring the reinforcement of the abrasive flaps. By virtue of the fact that the abrasive flaps are first of all arranged on the support and then provided with filling resin, a multiplicity of abrasive flaps can be provided with filling resin and reinforced in the desired manner. For example, the abrasive flaps arranged on the support are dipped with a desired alignment into a bath containing filling resin.

A method, in which the support rotates while the abrasive flaps are being dipped into a bath containing filling resin, in particular in such a way that the respective abrasive flap dips only temporarily into the filling resin, is a simple means of ensuring that the abrasive flaps are provided with filling resin. By virtue of the fact that the support rotates while the abrasive flaps are being dipped into the bath of filling resin, the abrasive flaps are provided or soddened with the filling resin in a uniform manner. The abrasive flaps are preferably dipped into the bath of filling resin in such a way that the respective abrasive flap is dipped in only temporarily. This ensures that the respective abrasive flap is provided or soddened with filling resin while being dipped and that the filling resin can drip off the abrasive material or abrasive material layer outside the bath of filling resin. The respective abrasive flap is preferably dipped into the bath of filling resin several times during the rotation of the support. The respective abrasive flap or base of the respective abrasive flap is thereby soddened substantially until it is saturated with filling resin.

A method, in which at least one strength-enhancing filler and/or filler with an abrasive action is mixed into the filling resin, is a simple means of setting the stiffness and/or abrasive properties of the abrasive flaps.

Further features, advantages and details of the invention will become apparent from the following description of a number of illustrative embodiments.

DETAILED DESCRIPTION

Figure 1:
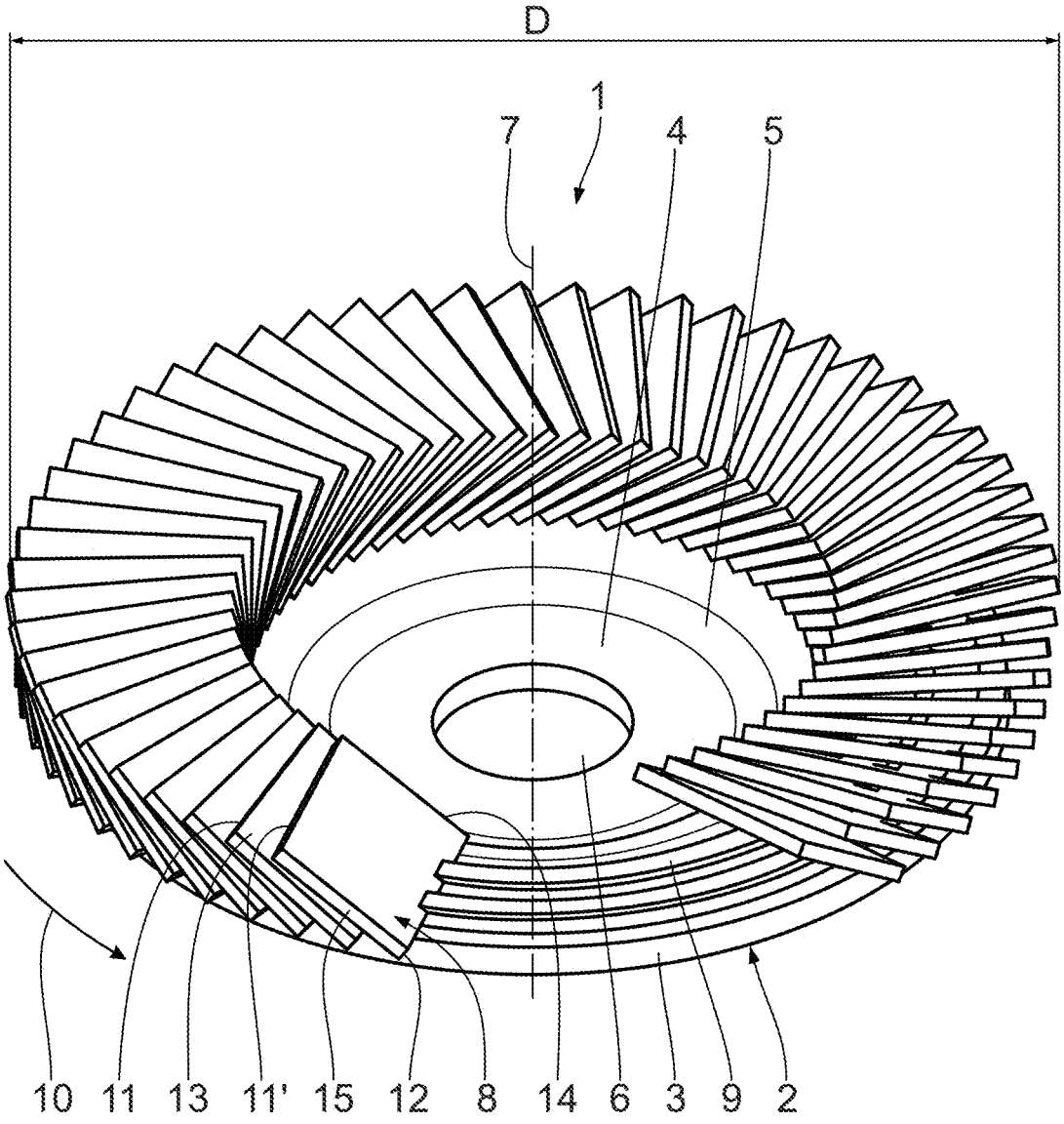
FIG. 1 shows a perspective view of an abrasive tool designed as an abrasive flap disk having a support and abrasive flaps arranged thereon, wherein a plurality of abrasive flaps have been omitted in order to illustrate the construction of the abrasive flap disk.
Figure 2:
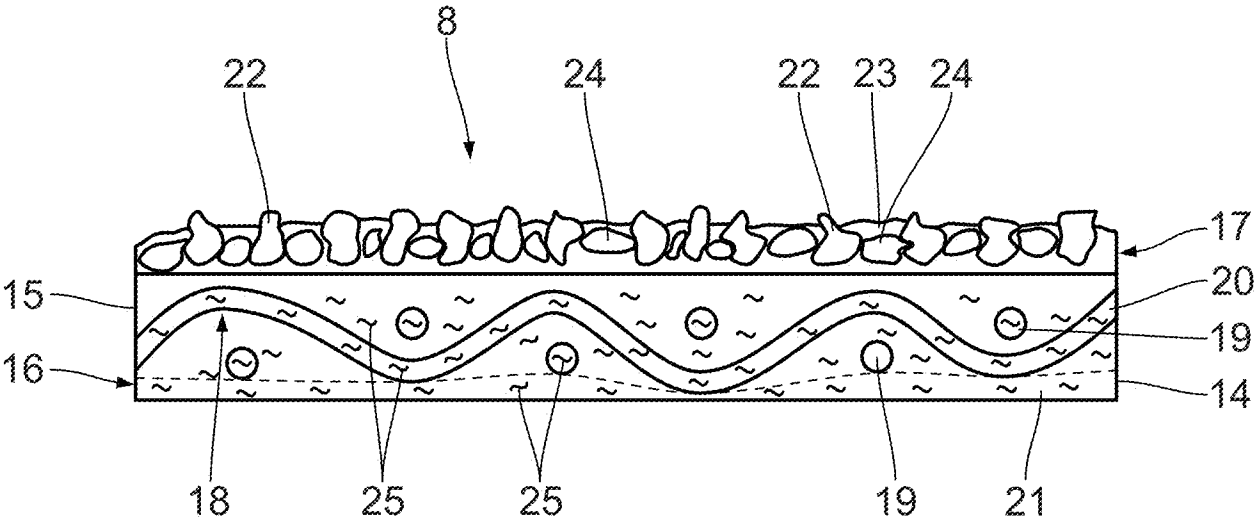
FIG. 2 shows a section through an abrasive flap of the abrasive flap disk in FIG. 1 in accordance with a first illustrative embodiment.

A first illustrative embodiment of the invention is described below with reference to FIGS. 1 to 6. An abrasive tool 1 designed as an abrasive flap disk has a support 2 of dish-shaped design. The support 2 comprises an outer, annular rim region 3 and a hub 4, which are connected by an annular web 5. The hub 4 has a concentric circular opening 6, which is used to clamp the support 2 and drive it in rotation about a central axis 7 by means of a tool drive (not shown specifically).

The rim region 3 is used to accommodate abrasive flaps 8. The abrasive flaps 8 are secured on the rim region 3, i.e. laterally on the support 2, by means of an adhesive layer 9 in such a way as to overlap one another. The abrasive flaps 8 are arranged on the support 2 at equal angular intervals. The abrasive flaps 8 have a trailing edge 11 and a leading edge 12, in each case when viewed in a direction of rotation 10 about the central axis 7. Each of the abrasive flaps 8 forms a region 13 with an abrasive action, which extends from the trailing edge 11 thereof as far as the trailing edge 11' of the abrasive flap 8 arranged ahead of it in the direction of rotation 10. The respective leading edge 12 is covered by the abrasive flap 8 arranged ahead of it in the direction of rotation 10. The abrasive flaps 8 are of rectangular design and each have an inner edge 14 facing the central axis 7 and an outer edge 15 facing away from the central axis 7. An outside diameter D of the abrasive tool 1 is defined by the outer edges 15 of the abrasive flaps 8.

The respective abrasive flap 8 has a base 16, to which an abrasive material layer 17 is applied. The base 16 comprises a supporting textile 18 in the form of a woven textile fabric formed from warp threads 19 and weft threads 20. On a side facing away from the abrasive material layer 17, the base 16 has a covering layer 21, which is referred to as the backing coat. The supporting textile 18 is joined to the covering layer 21, which is composed of a polymer dispersion, for example, and is cured by means of drawing. The supporting textile 18 is composed of polyester or cotton, for example, while the polymer dispersion is generally composed of resin and/or a plastics dispersion.

The abrasive material layer 17 comprises material abrasive 22, which is secured on the base 16 by means of a binder 23. The abrasive material 22 is in the form of abrasive particles or abrasive grains, which are incorporated into the binder 23 together with supporting grains 24. The binder 23 is designed as a binder resin, for example. The binder resin 23 and the filling resin 25 can be identical or different.

For reinforcement, the abrasive flaps 8 have a cured filling resin 25. The filling resin 25 is situated in and/or on the respective base 16. The warp threads 19 and the weft threads 20 of the supporting textile 18 are preferably provided with the filling resin 25 and reinforced by virtue of the curing of the filling resin 25. The base 16 is padded, for example, i.e. a full-bath sodding process is carried out, wherein penetration, in particular up to 100%, is brought about by a squeezing force exerted by roller pairs before drying takes place.

The cured filling resin 25 makes up 1% by weight to 30% by weight, in particular 5% by weight to 25% by weight and, in particular, 8% by weight to 20% by weight of the total weight of an abrasive flap 8.

Figure 3:
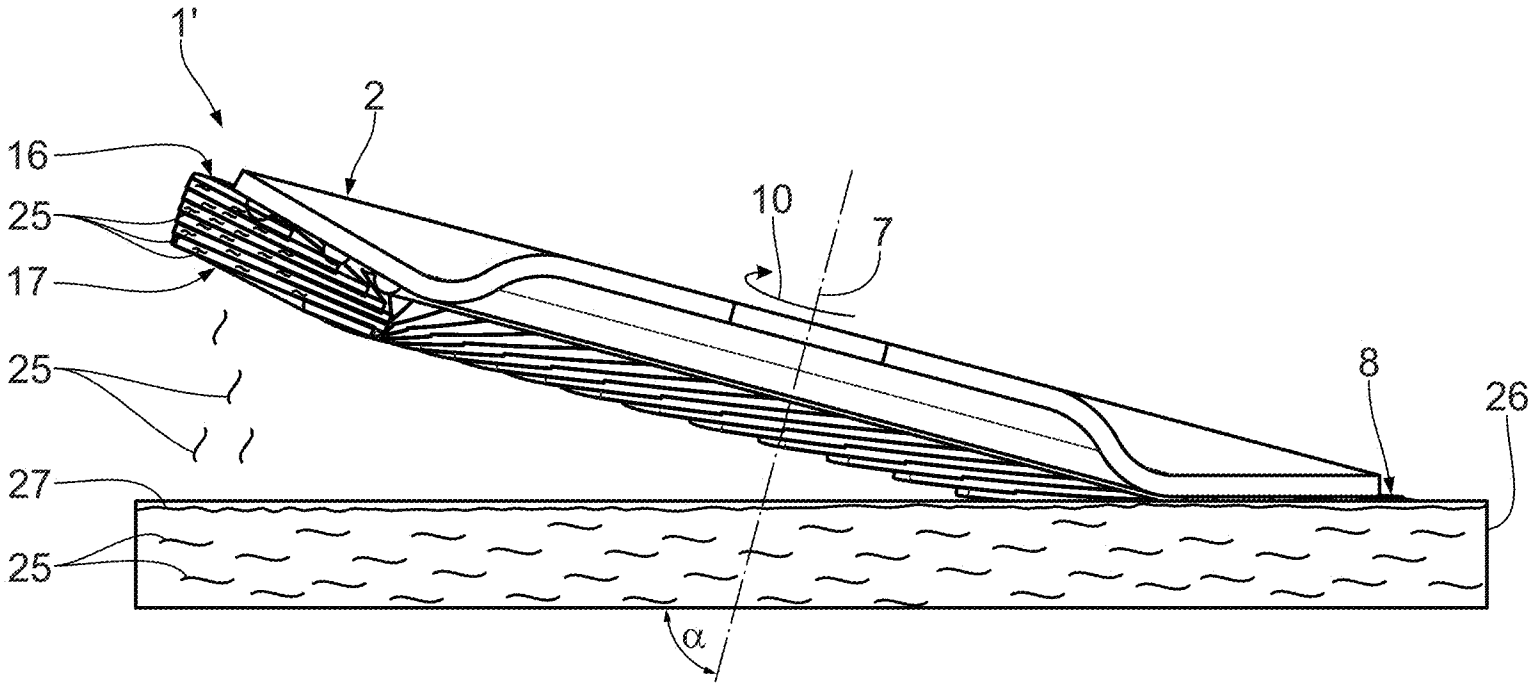
FIG. 3 shows a schematic illustration of a dipping process for providing the abrasive flaps with a filling resin.

The abrasive tool 1 according to the invention is produced as follows:

Before the curing of the filling resin 25, the unfinished abrasive tool is denoted below by the reference sign 1'. A bath containing the filling resin 25 is prepared in a vessel 26. The abrasive tool 1' is tilted in such a way for immersion of the abrasive flaps 8 that the central axis 7 encloses an angle $\alpha$ relative to a surface 27 of the filling resin 25. For the angle $\alpha$, the following preferably applies: $\alpha<90°$, in particular $\alpha\leq85°$, and, in particular, $\alpha\leq80°$. The abrasive tool 1' is arranged in such a way relative to the bath containing filling resin 25 that the abrasive flaps 8 closest to the filling resin 25, but not the support 2 connected to the abrasive flaps 8, dip into the resin. The abrasive tool 1' is rotated about the central axis 7, preferably in the direction of rotation 10, with the result that the abrasive flaps 8 dip into the bath and emerge again from the bath multiple times in succession. This is illustrated in FIG. 3.

By means of the multiple immersion of the abrasive flaps 8 in the filling resin 25, said flaps are provided with the filling resin 25. The filling resin 25 penetrates essentially into the respective base 16. In contrast, the filling resin 25 essentially drips off the respective abrasive material layer 17 again, with the result that the abrasive grains 22 are not covered by the filling resin 25.

After the abrasive flaps 8 have been provided with the filling resin 25, the resin is cured. Curing is preferably accomplished by supplying heat, e.g. by means of a furnace. The abrasive tool 1 according to the invention is produced or finished by means of the curing process. By virtue of the cured filling resin 25, the abrasive flaps 8 have increased stiffness.

Figure 4:
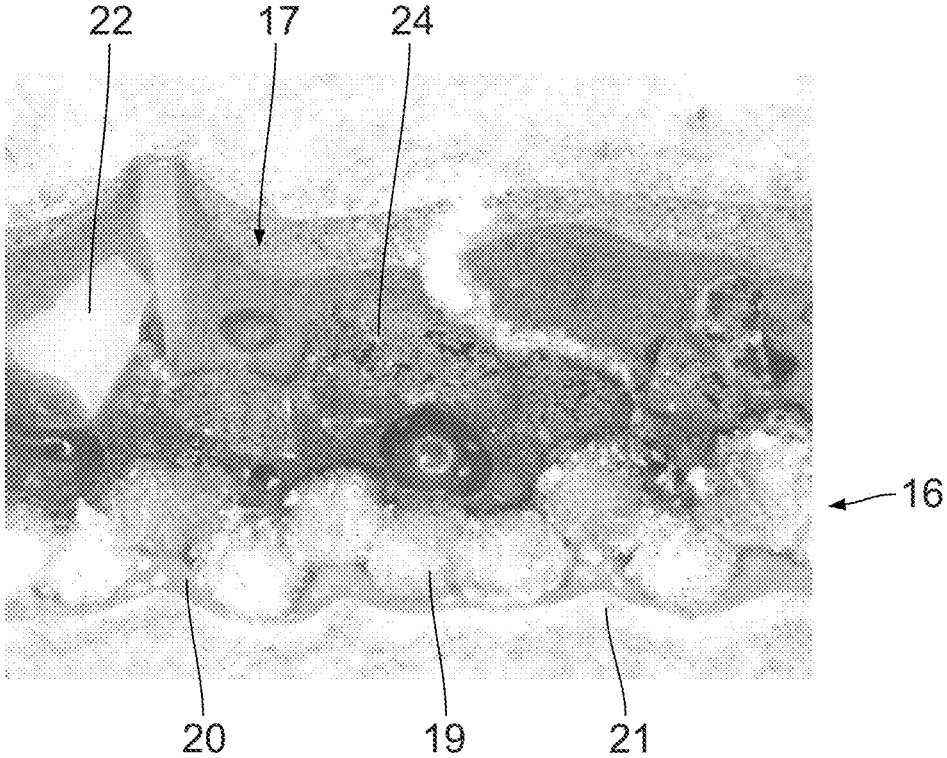
FIG. 4 shows a section through an abrasive flap before provision with a filling resin, magnified 50 times under a microscope.
Figure 5:
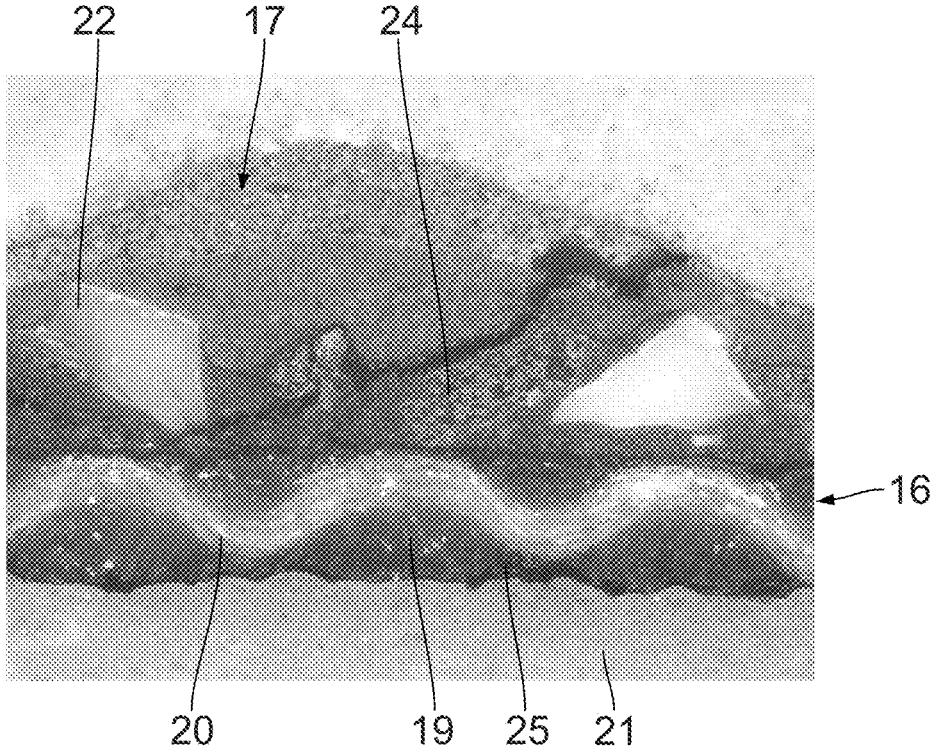
FIG. 5 shows a section through an abrasive flap after it has been provided with filling resin, magnified 50 times under a microscope.

FIG. 4 shows a section through an abrasive flap 8 of an unfinished abrasive tool 1' magnified 50 times under a microscope, whereas FIG. 5 shows a section through a reinforced abrasive flap 8 of an abrasive tool 1 according to the invention magnified 50 times under a microscope. A comparison of FIGS. 4 and 5 shows that the base 16 is provided with the filling resin 25, particularly in the region of the covering layer 21 and the adjacent supporting textile 18.

The filling resin 25 can be selected from the group comprising thermosets, elastomers, synthetic resins and/or thermoplastics and combinations thereof, for example. For example, the filling resin 25 is a synthetic resin, preferably a phenolic resin. The cured filling resin 25 should exhibit no softening behavior below a limiting temperature of, for example, 70° C. For example, its strength should be reduced below the limiting temperature by no more than 10% relative to its strength at room temperature, e.g. at 20° C. The properties of plastics, e.g. the behavior of the modulus of elasticity, as a function of temperature are fundamentally known (cf. Peter Eyerer, Thomas Hirth, Peter Elsner: Polymer Engineering, Springer-Verlag, 2008, pages 4 and 5).

Figure 6:
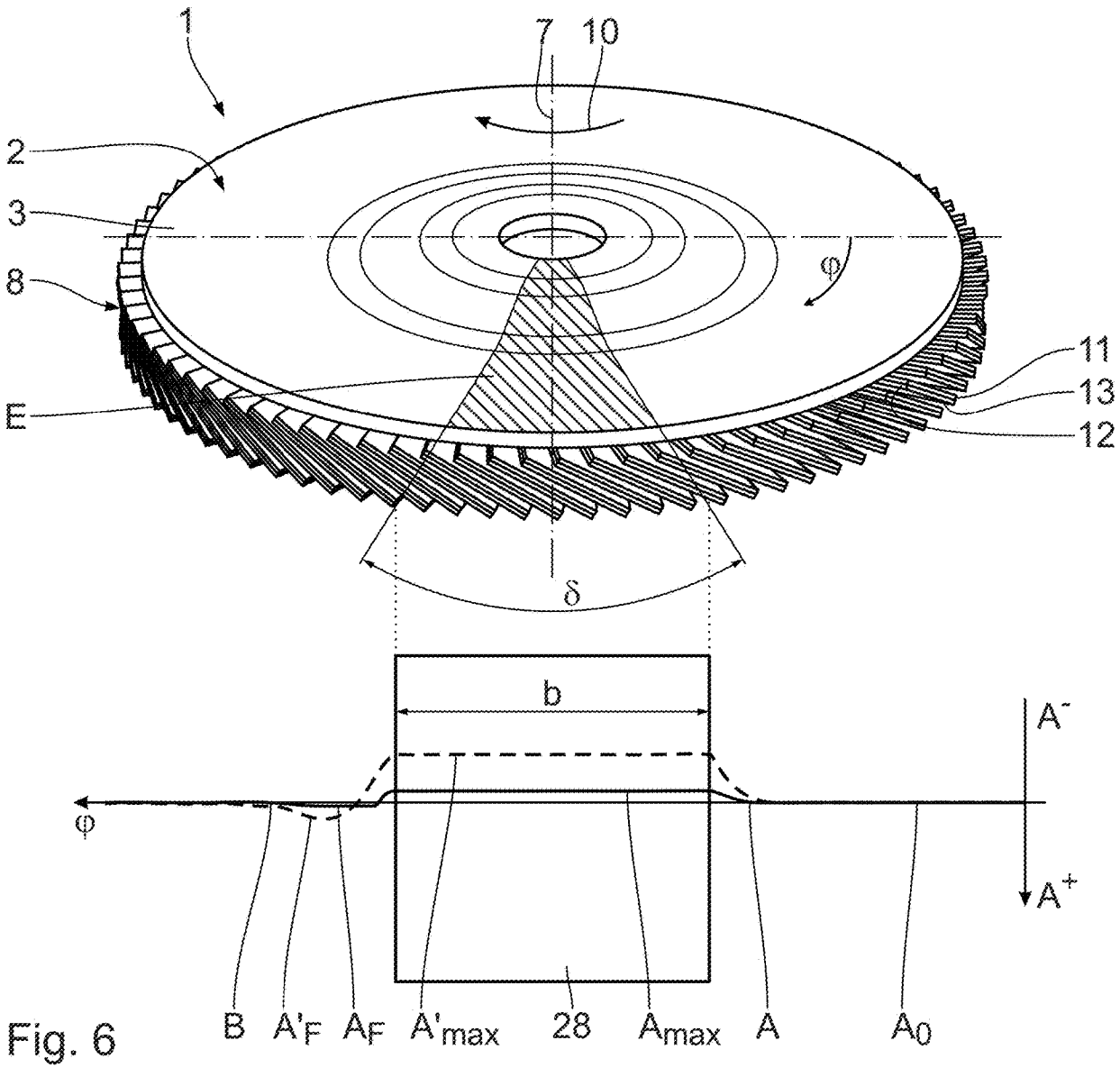
FIG. 6 shows a schematic illustration of the abrasive flap disk during the machining of a workpiece and the deflection of the abrasive flaps in accordance with a rotation angle of the abrasive flap disk.

The use of the abrasive tool 1 according to the invention is illustrated in FIG. 6. A workpiece 28 with a width b is to be machined by means of the abrasive tool 1. During the machining of the workpiece 28, the abrasive flaps 8 which are within an engagement region E are in abrasive engagement with the workpiece 28. The engagement region E is defined by an engagement angle δ. The engagement angle δ is dependent on the width b of the workpiece 28. Starting from a zero position $A_0$, the trailing edges 11 of the abrasive flaps 8 are deflected cyclically in a negative and a positive direction owing to the abrasive engagement. The zero position $A_0$ denotes the position of the trailing edges 11 of the abrasive flaps 8 in the rotating state of the abrasive tool 1 when out of contact with the workpiece 28. The zero position $A_0$ is thus dependent on the speed of the rotating abrasive tool 1 around the central axis 7 and on the outside diameter D.

The deflection A, illustrated in FIG. 6, as a function of a rotation angle φ describes the deflection of the trailing edge 11 of the respective abrasive flap 8 perpendicularly to the machined workpiece surface. The abrasive flaps 8 are bent in the negative direction, i.e. in the direction of the support 2, in accordance with the angular position thereof as they brush across the workpiece 28. The deflection starts even before the edge of the workpiece 28 in the angular position A since the deflection of the leading abrasive flaps 8 is transmitted by contact to the trailing abrasive flaps 8. In the engagement region E, the deflection in the negative direction is at a maximum. This is indicated by $A_{max}$. After the contact between the respective abrasive flap 8 and the workpiece 28 ends, it swings back and is initially deflected in the positive direction owing to an overshoot before the zero position $A_0$ is reached again. The maximum deflection in the positive direction during the overshoot is denoted by $A_F$. The angular position B denotes the point where the zero position $A_0$ is reached after the overshoot.

The maximum deflection $A_{max}$ and the deflection $A_F$ during the overshoot are dependent on the stiffness of the abrasive flaps 8 and on the loading thereof due to the machining of the workpiece 28. The loading of the abrasive flaps 8 is dependent on the angle at which the abrasive tool 1 is positioned relative to the workpiece surface to be machined, on the width b of the workpiece 28, on the number of abrasive flaps 8 simultaneously situated in abrasive engagement, on the contact force of the abrasive tool 1, i.e. the force with which the abrasive flaps 8 are pressed perpendicularly onto the workpiece surface in the abrasive process, on the speed and on the outside diameter D of the abrasive tool 1. The loading is greater, the greater is the oblique positioning, the contact force, the speed and the outside diameter and the smaller is the width b of the workpiece 28.

In FIG. 6, the deflection in the case of an abrasive tool in accordance with the prior art and with identical loading conditions is shown as a broken line for comparison purposes. The maximum negative deflection is indicated by $A'_{max}$ and the maximum deflection during the overshoot is indicated by $A'_F$. It can be seen that the maximum deflection $A_{max}$ and $A_F$ in the case of the abrasive tool 1 according to the invention is significantly less, and therefore the abrasive tool 1 according to the invention has a longer useful life and greater total material removal up to complete wear. In particular, the longer useful life and greater total material removal are not achieved by increasing the amount of wear on the base 16 and/or on the supporting textile 18. An increased proportion of respirable dust particles is thereby avoided.

Figure 7:
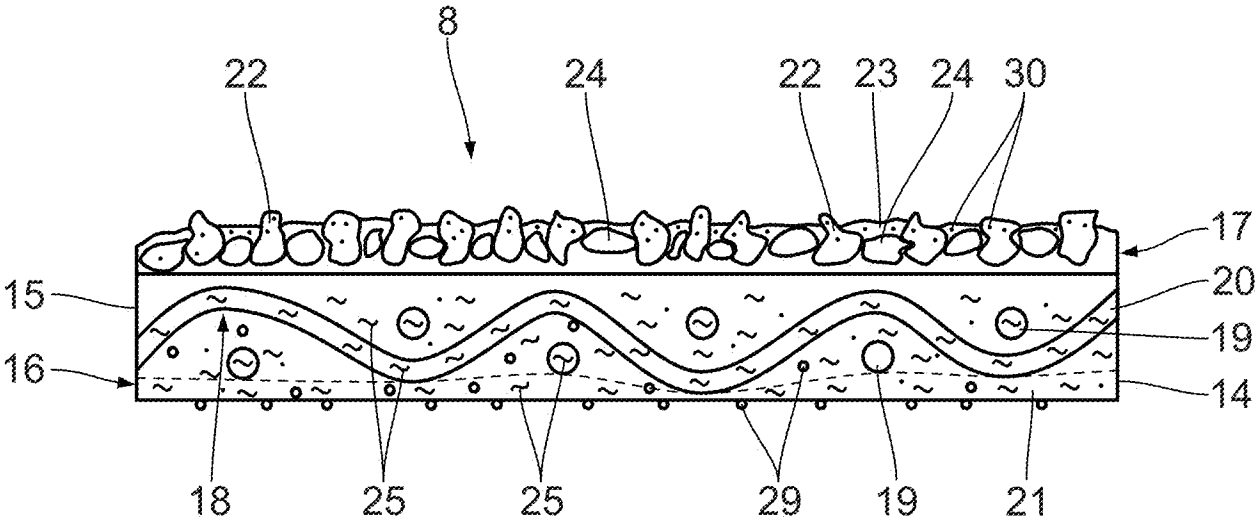
FIG. 7 shows a section through an abrasive flap in accordance with a second illustrative embodiment.

A second illustrative embodiment of the invention is described below with reference to FIG. 7. In contrast to the first illustrative embodiment, the filling resin 25 has a strength-enhancing filler 29 and/or a filler 30 with an abrasive action. The strength-enhancing filler 29 is situated in and/or on the base 16. The strength-enhancing filler 29 is chalk or alumina, for example. The strength-enhancing filler 29 is mixed into the bath containing the filling resin 25, with the result that the base 16 is provided with the filling resin 25 and additionally with the strength-enhancing filler 29 in accordance with the preceding illustrative embodiment and as described with reference to FIG. 3. As an alternative or in addition, the filler 30 with an abrasive action is mixed into the filling resin 25. The filler 30 with an abrasive action is cryolite and potassium tetrafluoroborate, for example. The filling resin 25 preferably contains the strength-enhancing filler 29 and the filler 30 with an abrasive action. In respect of the construction and production of the abrasive tool 1 in other respects, attention is drawn to the preceding illustrative embodiment.

The invention claimed is:

1. An abrasive tool having
- a support,
- a plurality of abrasive flaps,
  - which are arranged on the support, and
  - which each have a base and abrasive material, wherein the abrasive material is attached to the base by a binder, wherein at least one of the abrasive flaps has a cured filling resin for reinforcement and for reduction of cyclical deflection, and the respective base comprises at least one thread, which is soddened with the filling resin.

2. The abrasive tool as claimed in claim 1, wherein the respective base is provided with the cured filling resin.

3. The abrasive tool as claimed in claim 1, wherein the cured filling resin makes up 1% by weight to 30% by weight of the total weight of an abrasive flap.

4. The abrasive tool as claimed in claim 1, wherein at least one strength-enhancing filler is incorporated into the cured filling resin.

5. The abrasive tool as claimed in claim 1, wherein at least one filler with an abrasive action is incorporated into the cured filling resin.

6. The abrasive tool as claimed in claim 1, wherein the support is of dish-shaped design, and wherein the abrasive flaps are bonded laterally onto the support in such a way as to overlap one another.

7. A method for producing an abrasive tool, comprising the following steps:
- providing a plurality of abrasive flaps, which each have a base and abrasive material, wherein the abrasive material is attached to the base by means of a binder, wherein each base comprises at least one thread,
- arranging and securing the abrasive flaps on a support,
- providing at least one of the abrasive flaps with a filling resin, soddening the at least one thread of the respective base with the filling resin, wherein the at least one abrasive flap is provided with the filling resin after the abrasive flaps have been arranged on the support, and curing the filling resin to reinforce the at least one abrasive flap and to reduce cyclical deflection.

8. The method as claimed in claim 7, wherein the at least one abrasive flap is dipped into a bath containing filling resin.

9. The method as claimed in claim 7, wherein the support rotates while the abrasive flaps are being dipped into a bath containing filling resin.

10. The method as claimed in claim 7, wherein one of at least one strength-enhancing filler and a filler with an abrasive action is mixed into the filling resin.

* * * * *